US009609960B2

(12) United States Patent
Aumiller

(10) Patent No.: US 9,609,960 B2
(45) Date of Patent: Apr. 4, 2017

(54) MERCHANDISER TRIM ASSEMBLY

(71) Applicant: Hussmann Corporation, Bridgeton, MO (US)

(72) Inventor: Mel Aumiller, Chesterfield, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 14/227,851

(22) Filed: Mar. 27, 2014

(65) Prior Publication Data

US 2015/0272346 A1 Oct. 1, 2015

(51) Int. Cl.
*A47F 3/04* (2006.01)
*A47B 96/20* (2006.01)

(52) U.S. Cl.
CPC ..... *A47F 3/0426* (2013.01); *A47B 96/20* (2013.01); *A47F 3/0469* (2013.01); *A47F 3/0482* (2013.01); *Y10T 29/49826* (2015.01)

(58) Field of Classification Search
CPC ..... E04F 19/02; E04F 19/0691; E04F 19/061; E04C 2/296; E47F 3/0469; F25D 23/082; A47F 3/0426; A47F 3/0482; A47F 3/0469; A47B 96/20
See application file for complete search history.

(56) References Cited

U.S. PATENT DOCUMENTS 2,279,945 A * 4/1942 Hoffman ..... A47F 3/0482 220/592.09
2,624,649 A * 1/1953 Greiling ..... A47F 3/0482 312/107
2,814,185 A * 11/1957 Burg ..... 62/249
3,241,899 A * 3/1966 Donker ..... 312/116
3,349,220 A * 10/1967 Kinney ..... A47F 3/0469 219/218
3,542,445 A * 11/1970 Donker ..... 312/116
4,341,089 A * 7/1982 Ibrahim ..... F25D 21/04 62/236
4,369,631 A 1/1983 Abraham
4,424,685 A * 1/1984 Ibrahim ..... 62/249
4,948,206 A 8/1990 Fitzpatrick
5,289,657 A * 3/1994 Kiel ..... 49/478.1
5,639,149 A 6/1997 Grassmuck
6,119,420 A * 9/2000 Koenig, Jr. ..... E04F 13/06 52/255
6,655,766 B2 12/2003 Hodges
8,017,212 B2 * 9/2011 Leng ..... 428/73
(Continued)

FOREIGN PATENT DOCUMENTS

DE 1237595 B * 3/1967 ..... A47F 3/0482

*Primary Examiner* — Adriana Figueroa
*Assistant Examiner* — Jessie Fonseca
(74) *Attorney, Agent, or Firm* — Michael Best & Friedrich LLP

(57) ABSTRACT

A merchandiser panel assembly including a panel body at least partially defining a cavity. The merchandiser panel assembly includes a trim base attached to the panel body and partially enclosing the cavity along an edge of the panel body. The trim base is defined by an elongated body and includes an attachment feature positioned along at least one edge of the elongated body. The merchandiser panel assembly includes trim coupled to an exterior surface of the trim base. The merchandiser panel assembly includes insulation disposed within the cavity and captured by the panel body and the trim base.

18 Claims, 6 Drawing Sheets

(56) References Cited

U.S. PATENT DOCUMENTS

| | | | | |
|---|---|---|---|---|
| 8,517,477 | B2 | 8/2013 | Dickey et al. | |
| 8,534,029 | B2 * | 9/2013 | Leng | 52/796.11 |
| 2004/0031210 | A1 * | 2/2004 | Kjorsvik | 52/58 |
| 2009/0039040 | A1 | 2/2009 | Johnson et al. | |
| 2009/0072679 | A1 | 3/2009 | Avila et al. | |
| 2010/0058788 | A1 | 3/2010 | Iguchi et al. | |

* cited by examiner

MERCHANDISER TRIM ASSEMBLY

BACKGROUND

The present invention relates to a merchandiser trim assembly and, more particularly to a trim assembly for a merchandiser end panel.

Existing merchandiser panel assemblies typically include trim that is attached to the end panel by insulation that is placed in the panel body. Often, the merchandiser panel, the trim, or both are scrapped if the trim becomes damaged because removal of the trim would dislodge the insulation. Dislodging the insulation can result in a panel that has lower insulative properties and moisture entrainment problems.

SUMMARY

In one construction, the invention provides a merchandiser panel assembly that includes a panel body at least partially defining a cavity. The merchandiser panel assembly includes a trim base attached to the panel body and partially enclosing the cavity along an edge of the panel body. The trim base is defined by an elongated body and includes an attachment feature positioned along at least one edge of the elongated body. The merchandiser panel assembly includes trim coupled to an exterior surface of the trim base. The merchandiser panel assembly includes insulation disposed within the cavity and captured by the panel body and the trim base.

In another construction, the invention provides a merchandiser panel assembly that includes an end panel body having a bent edge at least partially defining a cavity. The merchandiser panel assembly includes a trim base attached to the panel body adjacent the bent edge to enclose the cavity. The trim base is defined by an elongated body and includes an attachment feature positioned along at least one edge of the elongated body. The merchandiser panel assembly includes insulation disposed in the cavity and captured by the attachment feature such that the insulation adheres to the end panel body and the trim base. The merchandiser panel assembly includes trim removably coupled to an exterior surface of the trim base.

In another construction, the invention provides a method of manufacturing a merchandiser panel assembly that includes a panel body. The method includes attaching a trim base to the panel body. The trim base and the panel body cooperatively define a cavity. The method also includes insulating the cavity, removably attaching trim to an exterior surface of the trim base, and selectively replacing the trim without removal or replacement of the insulation.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
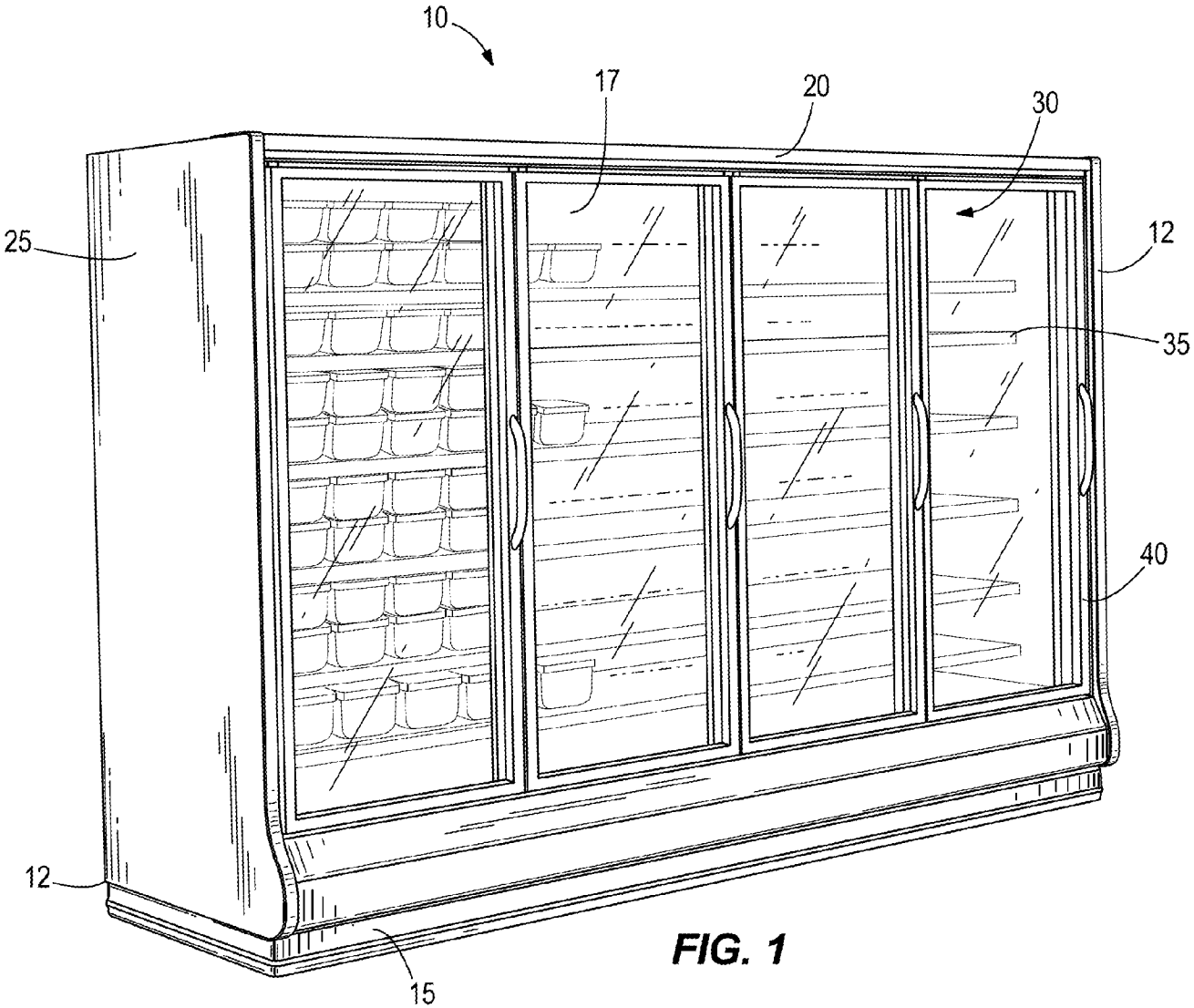
FIG. 1 is a perspective view of a merchandiser including end panels embodying the invention.

FIG. 1 illustrates an exemplary merchandiser 10 that may be located in a supermarket or a convenience store or other retail settings (not shown) for presenting fresh food, beverages, and other product (not shown) to consumers. The illustrated merchandiser 10 includes a case 12 that has base 15, a rear wall 17, a top wall or canopy 20, and sidewalls or end panel assemblies 25 (referred to as end panel assemblies for purposes of description only). The area at least partially enclosed by the base 15, the rear wall 17, the canopy 20, and the end panel assemblies 25 defines a product display area 30 in which product can be supported on shelves 35. As illustrated, the shelves 35 are positioned in an up-right or vertical merchandiser, and doors 40 enclose the access openings to the product display area 30. As will be appreciated, the merchandiser can take other forms (e.g., horizontal merchandisers, deli merchandisers, bakery merchandisers, open-front merchandisers, etc.).

Figure 2:
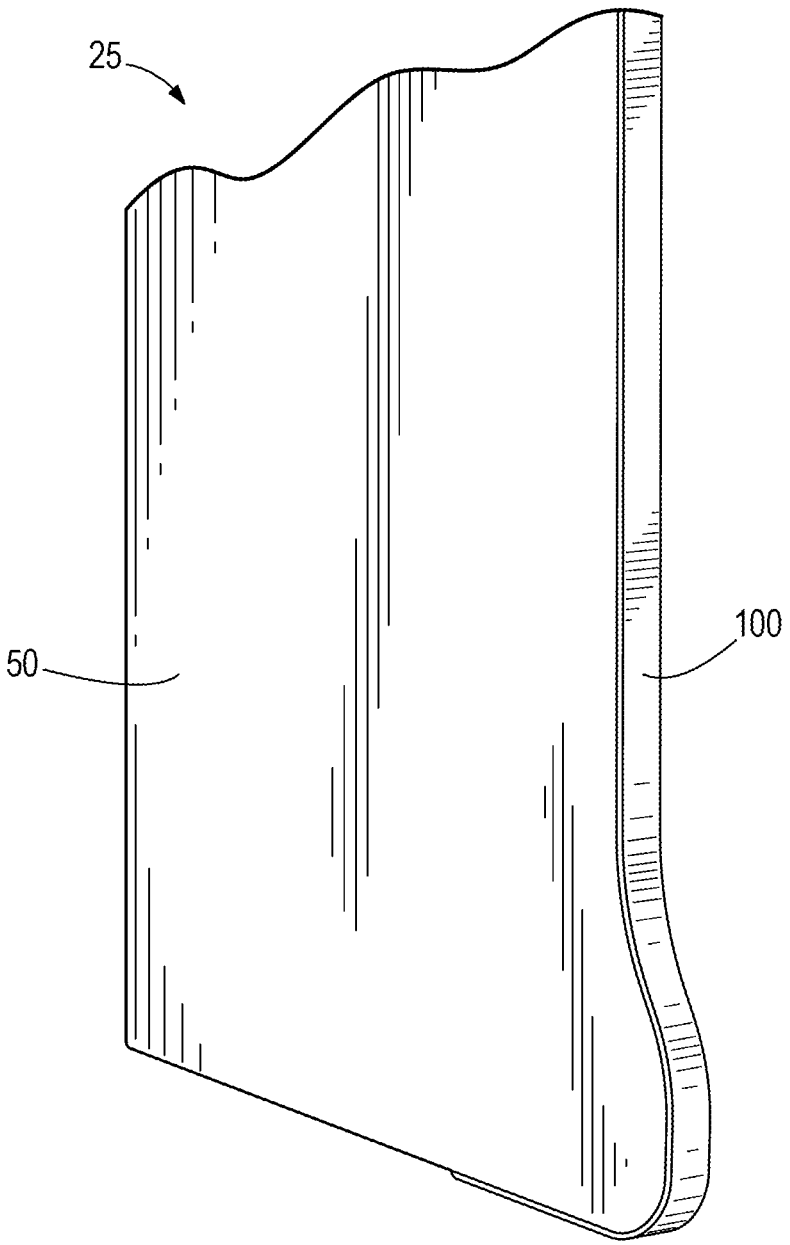
FIG. 2 is a perspective view of a portion of one merchandiser panel assembly.
Figure 3:
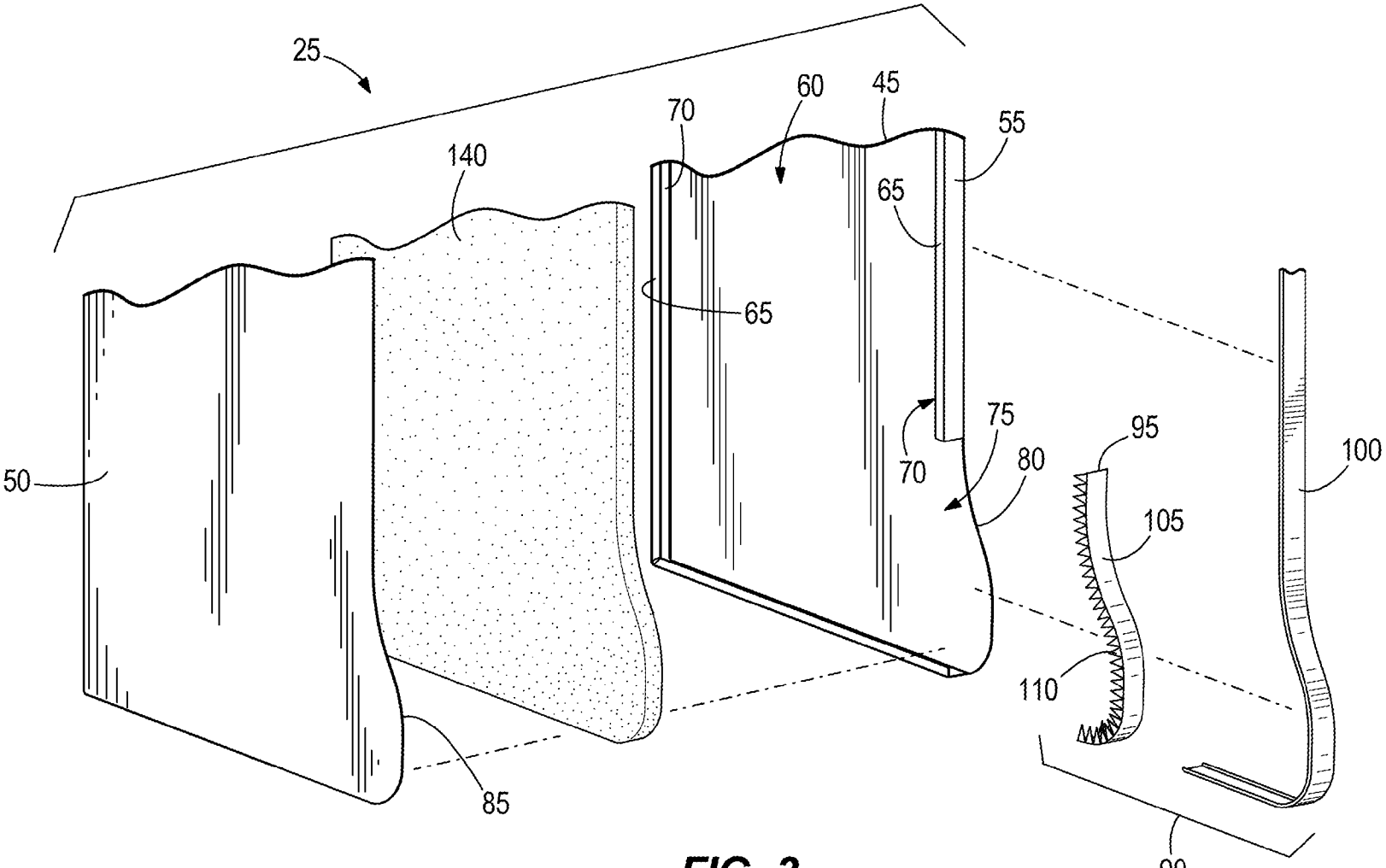
FIG. 3 is an exploded perspective view of the merchandiser panel assembly of FIG. 2, and which illustrates a panel body, insulation, a cover, a trim base, and trim.
Figure 4:
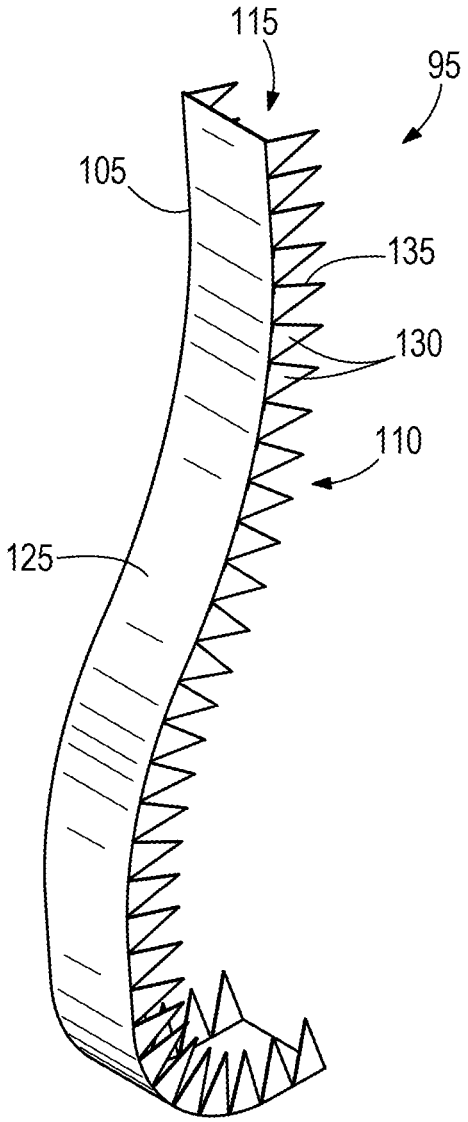
FIG. 4 is a front perspective view of the trim base.
Figure 5:
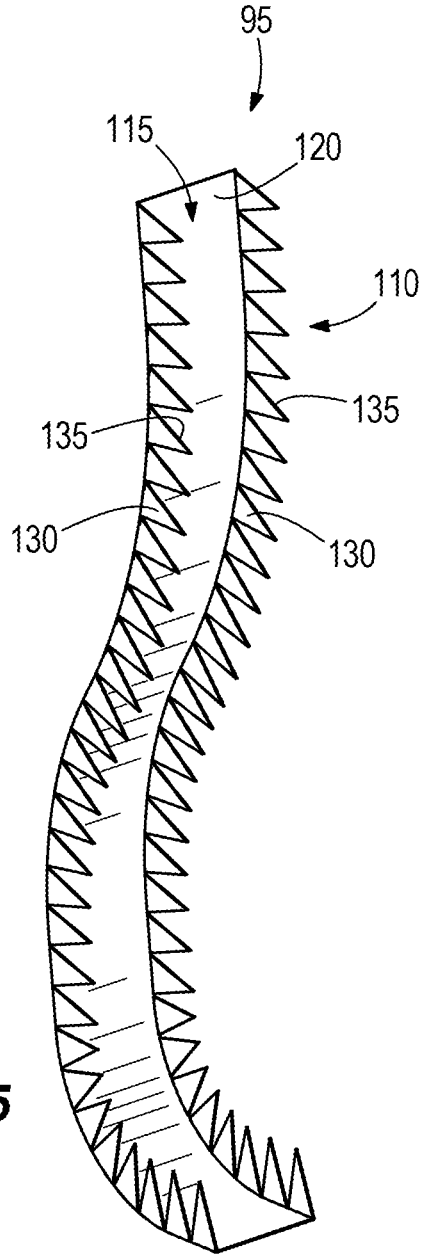
FIG. 5 is another perspective view of the trim base.

FIGS. 2 and 3 illustrate one of the end panel assemblies 25. Each end panel assembly 25 includes an inner panel body 45 and an outer panel body or cover 50. When the panel assembly 25 is assembled onto the merchandiser 10, the inner panel body 45 is oriented to face the product display area 30 and the cover is oriented to face outward.

Figure 7:
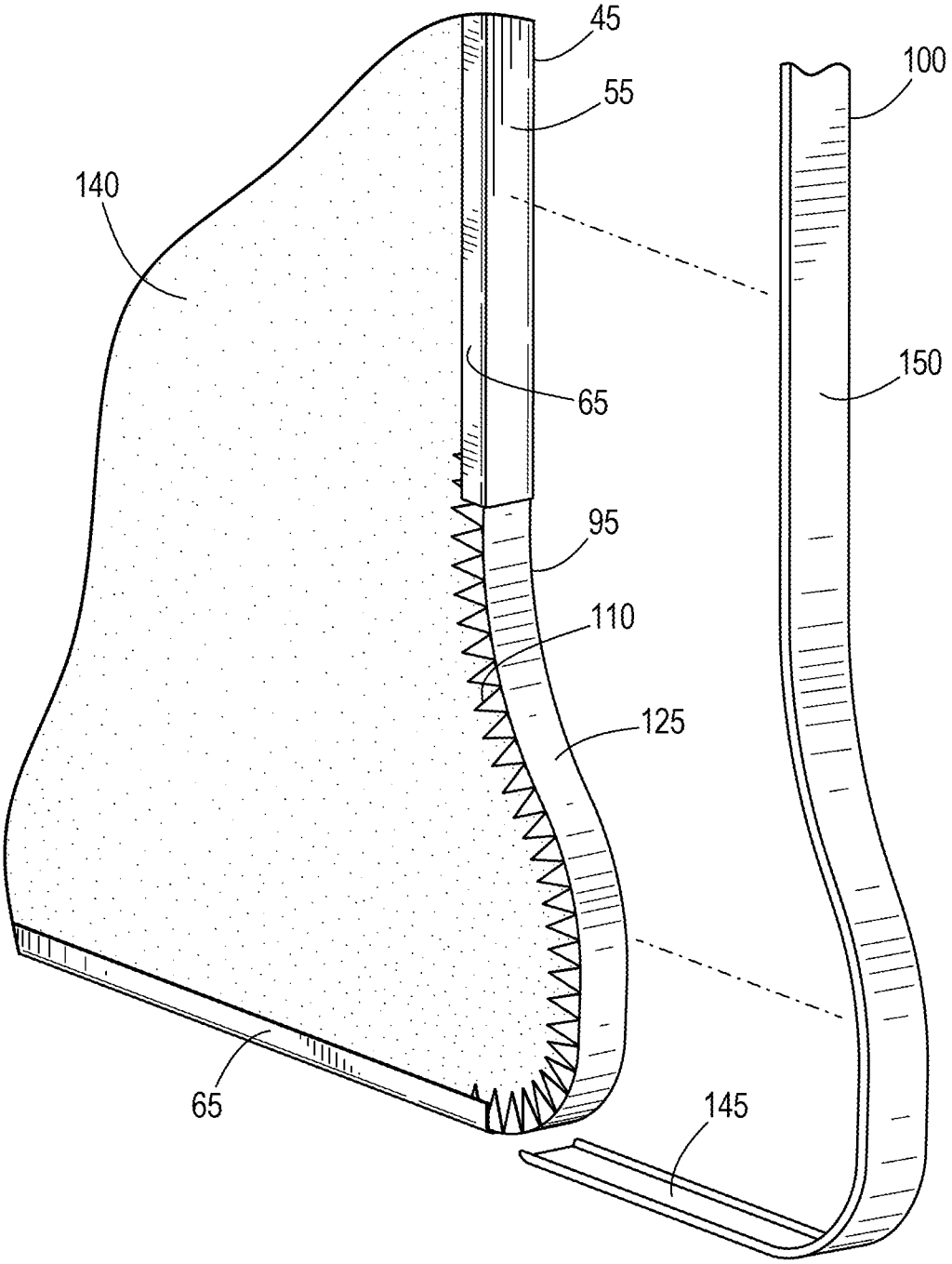
FIG. 7 is a perspective view of a portion of the merchandiser panel assembly with the cover removed and the trim exploded from the panel.

The inner panel body 45 has edges 55 that are bent to define a cavity 60 of the panel body 45. Each bent edge 55 also includes a lip 65 that forms a channel 70. The channels 60 are aligned with each other around the periphery of the panel body 45 and define the outermost boundary of the cavity 60. As shown in FIGS. 3 and 7, a portion of the panel body 45 has a gap or an open section 75 defined between ends of two adjacent bent edges 55. In other words, the open section 75 is defined by a planar edge 80 of the inner panel body 45 such that the cavity 60 can be accessed via the open section 75 when the outer panel body 50 is coupled to the inner panel body 50. The illustrated planar edge 75 is defined by a curvature that can vary depending on the desired shape for the end panel assembly 25. The curvature can be defined by a simple arc with a single radius, or by a more a complex curved shape with two or more radii. The inner panel body 45 can be formed or manufactured from sheet metal material that is bent to form the bent edges 55 and the channels 60, or from another material suitable for defining a merchandiser side wall.

The illustrated outer panel body 50 is planar and is attached to the lips 65 to enclose the face area of the cavity 60. Stated another way, the illustrated outer panel body 50 has planar edges 85 that are shaped to conform to the overall shape of the inner panel body 45. In some constructions, the outer panel body 50 can include bent edges in lieu of the bent edges 55 on the inner panel body 45. As shown, the outer panel body 50 has one planar edge 80 that is defined by a curvature that matches the curvature of the planar edge 80. The outer panel body 50 can be formed or manufactured from sheet metal material, or from another material suitable for defining a merchandiser side wall.

The panel assembly 25 also includes a trim assembly 90 that is coupled to the inner and outer panel bodies 45, 50 over the open section 75 and at least a portion of the bent edges 55 to provide a desired aesthetic appearance on the panel assembly 25. Referring to FIGS. 2-7, the trim assembly 90 includes a trim base 95 and trim 100 that is coupled to the trim base 95 and that is exposed when the panel assembly 25 is assembled onto the merchandiser 10.

FIGS. 3-7 illustrate the trim base 95, which is attached to the inner panel body 45 to enclose the cavity along the planar edge 80. More specifically, the trim base 95 is defined by an elongated body 105 and has an attachment feature 110 positioned along the lateral edges of the elongated body 105. The illustrated trim base 95 is formed of a material (e.g., galvanized aluminum, steel, composite, plastic, vinyl, etc.) that is relatively thin so that the trim base 95 can be shaped to conform to the curvature of the edges 80, 85. For example, the illustrated trim base 95 can be manufactured from galvanized aluminum that has a thickness between approximately 0.008 inches and approximately 0.021 inches (e.g., approximately 0.012 inches). The elongated body 105 and the attachment feature 110 cooperatively form a channel 115 that is defined by an interior surface 120 of the elongated body 105. As described in more detail below, the trim 100 is removably coupled to an exterior surface 125 of the elongated body 105.

With reference to FIGS. 4-7, the illustrated attachment feature 110 extends normal relative to the elongated body 105 and extends along the entire length of the trim base 95. In other constructions, the attachment feature 110 can extend along a portion of the entire length of the trim base 95. As shown, the attachment feature 110 has a "saw-tooth" configuration with teeth 130 arranged along the lateral edges of the elongated body 105. The illustrated teeth 130 have a triangular shape and are separated from each other by gaps 135. The teeth 130 provide structural rigidity to the trim base 95, whereas the relatively thin material of the trim base 95 and the gaps 135 permit adjustment of the curvature defined by the trim base 95 so that the curvature can match the planar edges 80, 85. Although the attachment feature 110 is illustrated and described as including triangular teeth 130 and the gaps 135, it should be appreciated that the teeth 130 and the gaps 135 can have other shapes, and that the attachment feature 110 can take other forms to provide structural rigidity and flexibility to the trim base 95.

Figure 6:
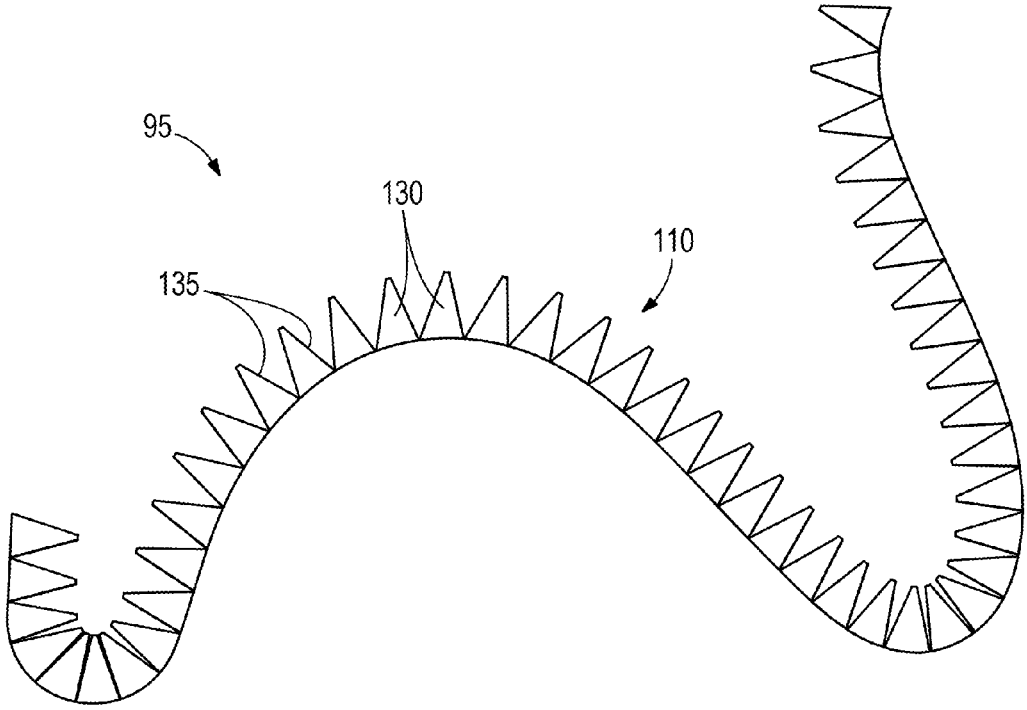
FIG. 6 is a side view of the trim base.

With reference to FIG. 6, the trim base 95 can be shaped to have one or more curved sections, straight sections, or any combination of curved and straight sections. Due to the arrangement of the attachment feature 110 on the edges of the elongated body 105, the trim base 95 can form one or more curves with a relatively large radius of curvature, one or more curves with a relatively small radius (e.g., approximately 1 inch), or any combination curves with large and/or small curvatures. That is, the attachment feature 110 permits flexibility of the trim base 70 while providing structural rigidity to the panel assembly 25.

The illustrated panel assembly 25 also includes insulation 140 that is positioned or otherwise disposed in the cavity 60 to assist with insulating the product display area 30. Preferably, the insulation 140 is an injected foam or a similar foam-in-place insulative material that adheres to the surfaces defining the cavity 60 (i.e. the channels 70 and the channel 115 of the inner panel body 45 and the trim base 95) to reduce the possibility that un-insulated voids form adjacent the edges of the panel assembly 25. In some constructions, the insulation 140 can be foam board or another insulative material. The insulation 140 is enclosed by the outer panel body 50.

The trim 100 is removably attached to the exterior surface 125 of the trim base 95 after the insulation 140 is placed in the cavity 60 by a mechanical fastener that permits selective removal of the trim 100 from the trim base 95. For example, the mechanical fastener can include bolts, clips, snaps, screws, or other similar fasteners, or an adhesive such as tape (e.g., ultra high bond tape such as VHB tape manufactured by 3M) or epoxy. In general, any fastener mechanism that permits removable attachment of the trim 100 to the trim base 95 can be used and should be considered herein.

With reference to FIGS. 2, 3, and 6, the illustrated trim 100 has a width that is slightly larger than the width defined by the width or thickness between the outer surfaces of the inner and outer panel bodies 45, 50 so that the trim 100 covers the underlying surfaces of the panel assembly 25 (e.g., the edges 55, 80, 85 of the panel bodies 45, 50, the exterior surface 125) that would otherwise be exposed without the trim 100. The trim 100 has a bonding surface 145, and an exposed or visible surface 150 that defines desired aesthetics of the trim 100. The trim 100 can be formed of metal (e.g., aluminum, stainless steel, etc.) that can be pre-formed to have the desired curvature or shape, or of a non-metal material (e.g., plastic, vinyl, composite, carbon fiber, etc.) that can take the shape of the exterior surface 125 upon attachment of the trim 100 to the trim base 95.

The end panel assembly 25 is assembled by forming the inner panel body 45 and attaching the trim base 95 to the body 45 over the open section 75. More specifically, the ends of the trim base 95 are inserted into the channels 70 so that the trim base channel 115 is aligned with the channels 70 to define a continuous perimeter around the panel body 45. The trim base 95 is manipulated so that the curvature defined by the trim base 95 corresponds or matches the curvature defined by the planar edges 80, 85 that form the open section 75. In some constructions, the trim base 95 can be temporarily or permanently fixed (e.g., taped using double-sided tape) to the inner panel body 45. After the trim base 95 is attached to the inner panel body 45, additional adhesive (i.e. tape) can be applied over the exposed attachment feature 110 and the outer body 50 to further secure the trim base 95 in place.

After the trim base 95 is attached to the inner panel body 45 (and in some circumstances after the outer panel body 50 is coupled to the inner panel body 45 and the trim base 95), the insulation 140 is placed in the cavity 60. As described above, in some constructions, the insulation 140 is adhered to the walls defining the cavity 60. The outer panel body 50 can be placed onto the lips 65 before or after the cavity 60 is insulated, depending on the assembly process that is used to assemble the end panel assembly 25. When an adhering insulative material is used, the outer panel body 50 can be at least partially secured to the inner panel body via the adhesive properties of the insulation 140. The insulation 140 is captured by the inner panel body 45 and the trim base 95 (via the attachment feature 110), and the outer panel body 50 further encloses the insulation 140 to hide the insulation 140 from view. The trim 100 is attached to the assembled end panel skeleton that is defined by the inner and outer panel bodies 45, 50 and the trim base 95. The trim 100 is shaped (before or during attachment) to follow the contour of the trim base 95.

If desired, the trim 100 can be removed from the end panel skeleton and replaced by other pieces of trim 100 (e.g., trim that has the same or different aesthetic characteristics) when the trim 100 is damaged during assembly of the end panel assembly 25 onto the remainder of the merchandiser 10 or damaged while the merchandiser 10 is in the retail environment, or if there is a desire to change the aesthetic characteristics of the merchandiser 10. For example, when the trim 100 is attached to the trim base 95 by an adhesive, a heat gun can be used to warm the adhesive to reduce its adhesiveness and facilitate removal of the trim 100. Thereafter, the adhesive can be replaced and another trim 100 can be installed onto the trim base 95. The end panel assembly 25 is constructed to enable removal and replacement of the trim 100 from the trim base 95 without affecting the insulation 140.

Various features of the invention are set forth in the following claims.

The invention claimed is:

1. A merchandiser panel assembly comprising:

a panel body defining a facing surface of the merchandiser panel assembly and including a first edge, a second edge, and a third edge, each of the first edge and the second edge is bent to cooperatively at least partially define a cavity, each of the first edge and the second edge having a flange cooperating with the facing surface to define respective channels along a periphery of the panel body, the panel body further including an open section defined by the third edge and disposed between respective ends of the first and second edges such that the cavity can be accessed via the open section;

a trim base attached to the panel body within the channels and extending between the first edge and the second edge across the open section to at least partially enclose the cavity, the trim base defined by an elongated body and including a serrated attachment feature positioned along the third edge of the elongated body such that the serrated attachment feature is positioned and arranged to adapt a curvature of the trim base to a curvature of the panel body;

trim coupled to an exterior surface of the trim base; and insulation disposed within the cavity and captured by the panel body and the trim base.

2. The merchandiser panel assembly of claim 1, wherein the panel body defines an end panel of a merchandiser.

3. The merchandiser panel assembly of claim 1, wherein the trim is removably attached to the trim base by a mechanical fastener.

4. The merchandiser panel assembly of claim 1, wherein the trim is removably attached to the trim base by an adhesive.

5. The merchandiser panel assembly of claim 1, wherein the serrated attachment feature includes a plurality of teeth extending along a length of the trim base, and wherein gaps between the teeth permit adjustment of the curvature of the trim base.

6. The merchandiser panel assembly of claim 1, wherein the insulation includes foam-in-place insulation and the panel body and the trim base are secured to each other via the foam-in-place insulation.

7. The merchandiser panel assembly of claim 1, wherein the channels are aligned with with each other when the trim base is attached to the panel body, and wherein the insulation is engaged with the panel body and the trim base within the channels.

8. A merchandiser panel assembly comprising:

a first end panel body;

a second end panel body disposed opposite the first end panel body and including a bent edge at least partially defining a cavity and having a flange at least partially defining a channel;

a trim base attached to the second end panel body adjacent the bent edge to enclose a periphery of the cavity, the trim base defined by an elongated body and including an attachment feature positioned along an edge of the elongated body;

insulation disposed in the cavity and captured by the attachment feature such that the insulation adheres to the second end panel body and the trim base; and trim removably coupled to an exterior surface of the trim base, wherein the trim base is positioned in the channel to attach the trim base to the second end panel body, and wherein the first end panel body is coupled to the flange to enclose a face area of the cavity.

9. The merchandiser panel assembly of claim 8, wherein the trim base is coupled to the bent edge such that the bent edge and the trim base define a continuous edge surrounding the cavity.

10. The merchandiser panel assembly of claim 8, wherein the trim is removably attached to the trim base by a mechanical fastener.

11. The merchandiser panel assembly of claim 8, wherein the trim is removably attached to the trim base by an adhesive.

12. The merchandiser panel assembly of claim 8, wherein the attachment feature is positioned and arranged to adapt a curvature of the trim base to a curvature of the second end panel body.

13. The merchandiser panel assembly of claim 12, wherein the attachment feature includes a plurality of teeth extending along a length of the trim base, and wherein gaps between the teeth permit adjustment of the curvature of the trim base.

14. The merchandiser panel assembly of claim 12, wherein the insulation includes foam-in-place insulation.

15. A method of manufacturing a merchandiser panel assembly including a panel body, the method comprising:

forming a first bent edge and a second bent edge on the panel body, the first and second bent edges cooperatively at least partially defining a cavity, the panel body further including an open section defined between respective ends of the first and second bent edges such that the cavity can be accessed via the open section;

forming a flange on each of the first bent edge and the second bent edge, the flange cooperating with a facing surface of the panel body to define respective channels along a periphery of the panel body;

attaching a trim base to the panel body within the channels, the trim base defined by an elongated body extending between the first bent edge and the second bent edge across the open section to at least partially enclose the cavity, and the trim base including an attachment feature having a plurality of segments positioned along and extending from an edge of the elongated body, and the trim base and the panel body cooperatively defining a cavity;

adapting a curvature of the trim base to a curvature of the panel body by positioning and arranging the segmented attachment feature relative to the panel body;

insulating the cavity;

removably attaching trim to an exterior surface of the trim base; and selectively replacing the trim without removal or replacement of the insulation.

16. The method of claim 15, further comprising adapting a curvature of the trim base to conform to a curvature of an edge of the panel body.

17. The method of claim 15, further comprising adhering the trim to the exterior surface.

18. The method of claim 15, further comprising adhering the insulation to the panel body and the trim base, wherein the trim base is positioned between the insulation and the trim.

* * * * *